US009351592B2

(12) United States Patent
Wilke

(10) Patent No.: US 9,351,592 B2
(45) Date of Patent: May 31, 2016

(54) SUPPORT FOR STORING AND DISPLAYING ELONGATE ARTICLES

(71) Applicant: Wine Cellar Innovations LLC, Cincinnati, OH (US)

(72) Inventor: Anthony J. Wilke, Cincinnati, OH (US)

(73) Assignee: Wine Cellar Innovations LLC, Cincinnati, OH (US)

( * ) Notice: Subject to any disclaimer, the term of this patent is extended or adjusted under 35 U.S.C. 154(b) by 0 days.

(21) Appl. No.: 14/478,826

(22) Filed: Sep. 5, 2014

(65) Prior Publication Data

US 2016/0066713 A1 Mar. 10, 2016

(51) Int. Cl.
*A47B 73/00* (2006.01)
*A47F 5/08* (2006.01)
(Continued)

(52) U.S. Cl.
CPC ..... *A47F 7/0035* (2013.01); *A47B 47/021* (2013.01); *A47B 55/02* (2013.01); *A47B 57/045* (2013.01); *A47B 73/002* (2013.01); *A47B 96/021* (2013.01); *A47F 5/0018* (2013.01); *A47F 5/0043* (2013.01); *A47F 5/01* (2013.01); *A47F 7/28* (2013.01)

(58) Field of Classification Search
CPC ..... A47F 7/0035; A47F 7/0021; A47F 7/283; A47F 5/0018; A47F 5/0043; A47F 5/0081; A47F 5/01; A47F 5/08; A47F 5/10; A47F 5/13; A47F 7/28; A47B 81/007; A47B 96/02; A47B 96/021; A47B 96/027; A47B 47/00; A47B 47/02; A47B 47/021; A47B 55/02; A47B 57/04; A47B 57/045; A47B 73/00; A47B 73/002; A47B 73/008
USPC ..... 211/74, 106, 193, 181.1, 75, 87.01
See application file for complete search history.

(56) References Cited

U.S. PATENT DOCUMENTS

| | | | |
|---|---|---|---|
| 2,286,831 | A | 6/1942 | Ressinger |
| D190,353 | S | 5/1961 | Chesley |

(Continued)

FOREIGN PATENT DOCUMENTS

| | | | |
|---|---|---|---|
| DE | 202013105392 | U1 | 2/2014 |
| EP | 1749459 | A1 | 2/2007 |
| KR | 100786255 | B1 | 12/2007 |

OTHER PUBLICATIONS

KV, "80 Series Standard & 180/181 Series Bracket System", http://www.robertscoinc.com/pdf/KANPE%20VOGT%2080%20AND%20180.pdf, copyright 2009, p. 4, accessed Dec. 5, 2014.

*Primary Examiner* — Jennifer E Novosad
(74) *Attorney, Agent, or Firm* — Wood, Herron & Evans, LLP

(57) ABSTRACT

A support for storing and displaying elongate articles includes at least one shelf selectively adjustably couplable with a support frame in at least first and second orientations. The at least one shelf includes first locating structure associated with the first orientation and engagable with at least one elongate article placed in contact with the first locating structure to locate the at least one article on the shelf so that a longitudinal axis of the at least one elongate article is aligned in a first direction. The at least one shelf further includes second locating structure associated with the second orientation and engagable with an elongate article when the elongate article is placed in contact with the second locating structure to locate the elongate article on the at least one shelf so that the longitudinal axis of the elongate article is aligned in a second direction.

19 Claims, 6 Drawing Sheets

(51) Int. Cl.

| | |
|---|---|
| ***A47F 5/14*** | (2006.01) |
| ***A47F 7/00*** | (2006.01) |
| ***A47F 7/28*** | (2006.01) |
| ***A47B 47/02*** | (2006.01) |
| ***A47B 96/02*** | (2006.01) |
| ***A47F 5/01*** | (2006.01) |
| ***A47F 5/00*** | (2006.01) |
| ***A47B 55/02*** | (2006.01) |
| ***A47B 57/04*** | (2006.01) |

(56) References Cited

U.S. PATENT DOCUMENTS

| | | | | |
|---|---|---|---|---|
| 3,835,793 | A | 9/1974 | Goddard | |
| 3,907,119 | A | 9/1975 | Franz | |
| D323,600 | S | 2/1992 | Patke | |
| D330,987 | S | 11/1992 | Rosenthal | |
| 5,169,009 | A * | 12/1992 | Bomze | A47B 73/00 211/187 |
| 5,379,905 | A * | 1/1995 | Bustos | A47F 5/0025 206/201 |
| 5,538,147 | A * | 7/1996 | Fucci | A47F 5/01 108/90 |
| 5,711,436 | A * | 1/1998 | Moeller | A47G 23/0208 211/106 |
| 5,826,731 | A * | 10/1998 | Dardashti | A47B 73/002 211/74 |
| 6,619,489 | B2 * | 9/2003 | Kessel | A47B 47/03 211/181.1 |
| 6,991,117 | B2 | 1/2006 | McCain | |
| D526,168 | S | 8/2006 | Goodman et al. | |
| 7,377,397 | B2 * | 5/2008 | Lee | A47B 55/02 211/126.14 |
| 7,516,853 | B1 * | 4/2009 | Murillo, Jr. | A47F 5/0018 211/188 |
| 7,850,017 | B2 | 12/2010 | McCain | |
| 7,882,967 | B2 * | 2/2011 | Hynes | A47B 73/00 211/75 |
| D637,427 | S | 5/2011 | Troyner et al. | |
| 7,984,813 | B1 * | 7/2011 | Tapager | A47G 23/02 211/74 |
| 8,033,402 | B1 * | 10/2011 | Bevis | A47B 73/008 211/74 |
| 8,231,015 | B2 | 7/2012 | McCain | |
| 8,567,617 | B1 * | 10/2013 | Tapager | A47G 23/02 211/60.1 |
| D698,589 | S | 2/2014 | Troyner et al. | |
| 8,714,373 | B2 * | 5/2014 | Danehy | A47F 3/14 206/509 |
| 8,720,704 | B2 | 5/2014 | Gupta | |
| 8,869,997 | B2 * | 10/2014 | Collini | A47B 73/00 211/74 |
| 2001/0025824 | A1 * | 10/2001 | Olivero | A47B 73/00 211/74 |
| 2002/0066708 | A1 * | 6/2002 | Gerard | A47F 7/283 211/74 |
| 2004/0089621 | A1 * | 5/2004 | Gangloff | A47F 7/283 211/74 |
| 2005/0211648 | A1 * | 9/2005 | Haller | A47B 57/04 211/75 |
| 2006/0219648 | A1 * | 10/2006 | Vinals Calduch | A47B 73/00 211/74 |
| 2009/0026157 | A1 * | 1/2009 | Gibert Guasch | B65D 71/70 211/74 |
| 2010/0252516 | A1 * | 10/2010 | Huang | A47B 96/027 211/134 |
| 2011/0132853 | A1 | 6/2011 | Drobot et al. | |
| 2011/0309220 | A1 | 12/2011 | Collini | |
| 2012/0085721 | A1 | 4/2012 | Michael J. et al. | |
| 2013/0191987 | A1 | 8/2013 | Yang et al. | |
| 2013/0233814 | A1 * | 9/2013 | Gupta | A47B 57/38 211/74 |

* cited by examiner

SUPPORT FOR STORING AND DISPLAYING ELONGATE ARTICLES

TECHNICAL FIELD

The present invention relates generally to devices for storing articles, and more particularly, to devices for storing and displaying elongate articles.

BACKGROUND

Traditional support devices for storing bottles, such as wine bottles, generally include a plurality of longitudinal compartments extending orthogonally from a back wall and having circular or square cross-sections. Each compartment generally receives a single bottle such that either a closure-end (also referred to as a "cork-end") or a bottom-end of the bottle faces outwardly and can be seen through the opening of the compartment. However, this method of storing bottles is problematic for an observer wishing to quickly view a descriptive label provided on a body of the bottle (the portion of the body having the label referred to as the "label-side" of the bottle). In particular, the body of the bottle and the label are disposed within the compartment and thereby generally concealed from view. Accordingly, viewing the label on the bottle requires partially or completely removing the bottle from its storage compartment.

Improved support devices for storing bottles have allowed for aligning a bottle in one or more preferred directions in which a label-side of the bottle is readily visible to an observer without having to fully or partially remove the bottle from its displayed location. For example, in a first direction of a bottle, the bottle may be aligned such that its longitudinal axis extends generally parallel to front and back portions of the support device, such that the body of the bottle faces an observer. In a second direction of the bottle, the bottle may be aligned such that its longitudinal axis extends generally orthogonal to the front and back portions of the support device, such that either the closure-end or the bottom-end of the bottle faces the observer.

However, known support devices for storing bottles remain deficient in providing a structure that is selectively adjustable for displaying a plurality of bottles with label-sides of the bottles visible to an observer. For example, modular support devices include various individual components that must be installed, repositioned, and/or removed depending on the direction in which one or more bottles are to be aligned for display. Other designs minimize the number of components of the support device, but in doing so provide a structure that is limited in its ability to display various quantities and arrangements of bottles aligned in a particular direction. Accordingly, there remains a need for improvement of support devices for storing and displaying bottles.

SUMMARY

An exemplary embodiment of a support for storing and displaying elongate articles in accordance with the principles of the invention includes at least one shelf that is selectively adjustably couplable with a support frame in at least first and second orientations. A first locating structure on the shelf is associated with the first orientation and is engagable with at least one elongate article placed in contact with the first locating structure to locate the at least one elongate article on the at least one shelf so that a longitudinal axis of the at least one elongate article is aligned in a first direction. A second locating structure on the shelf is associated with the second orientation and is engagable with an elongate article placed in contact with the second locating structure to locate the elongate article on the at least one shelf so that a longitudinal axis of the elongate article is aligned in a second direction.

In another exemplary embodiment, a method of storing and displaying elongate articles with a support having at least one shelf includes selectively providing a first shelf in a first orientation. The at least one shelf includes a first side with first locating structure and a second side with second locating structure. The at least one shelf is positionable in a first orientation in which the first side faces in a generally upward direction, and a second orientation in which the second side faces in a generally upward direction. The method further includes supporting at least one elongate article on the first shelf anywhere substantially along the entire length of the first shelf, such that the first locating structure engages the at least one elongate article and aligns a longitudinal axis of the at least one elongate article parallel with a first direction defined by a longitudinal axis of the first locating structure.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

FIG. 7 is also a partial side elevation view of the support in FIG. 4, showing an article being supported in a second direction by second locating structure.

DETAILED DESCRIPTION

Figure 1:
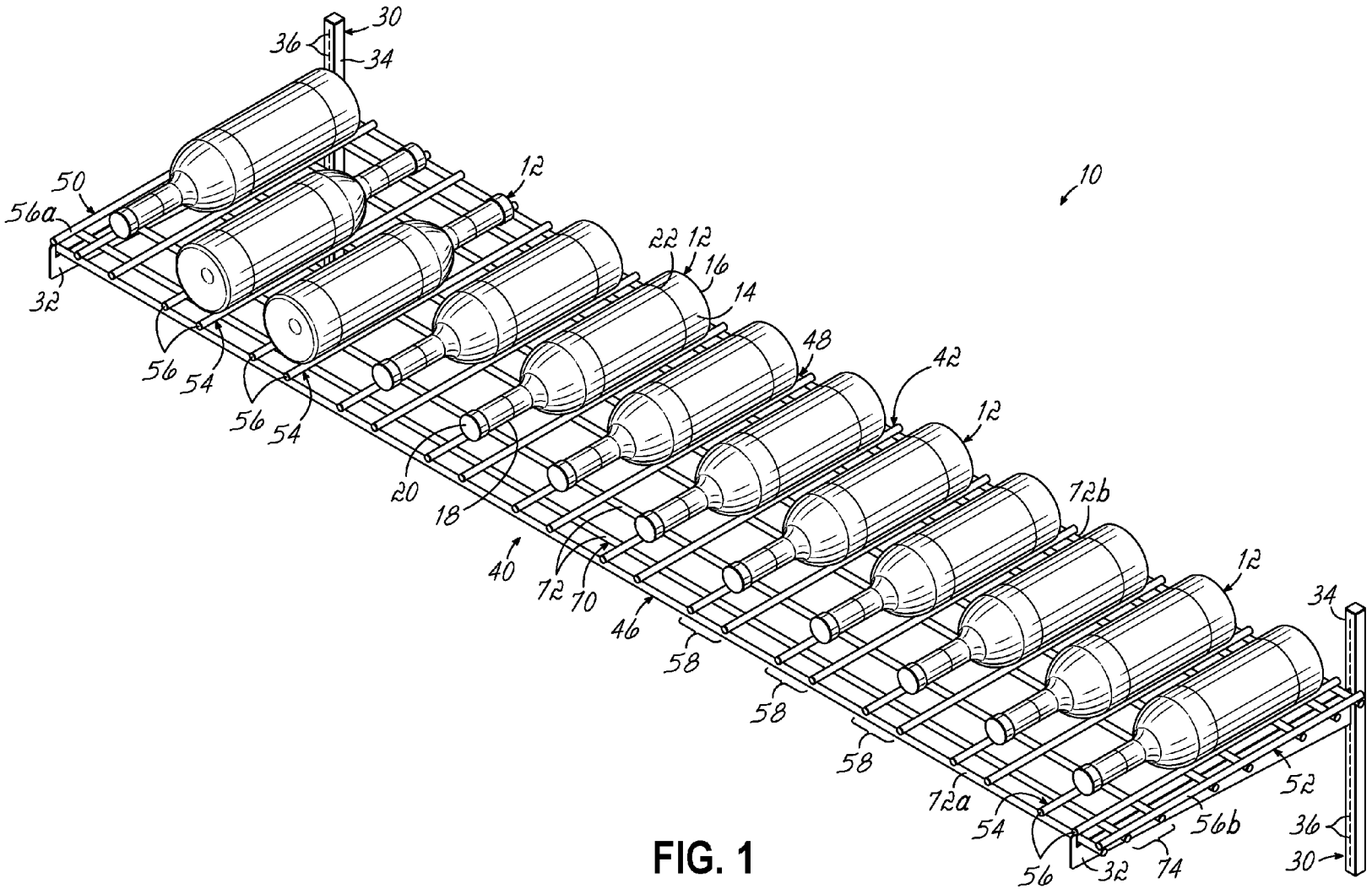
FIG. 1 is a perspective view of an exemplary embodiment of a support for storing and displaying articles in accordance with the principles of the invention.

Referring to FIG. 1, an exemplary embodiment of a support 10 for storing and displaying elongate articles in accordance with the principles of the invention is shown. The elongate articles are shown in the form of wine bottles 12, each bottle 12 including a body 14 having a bottom-end 16, and a neck 18 extending from the body 14 and defining a closure-end 20 for receiving a cork or a cap, for example. An outer periphery of the body 14 may include a label 22 identifying the contents of the bottle 12. While each bottle body 14 is shown as having a generally uniform cylindrical shape, the bottles 12 may be of various other shapes and sizes. Additionally, persons skilled in the art will appreciate that the support 10 may be used in connection with various articles other than wine bottles, such as various other types of beverage containers, food items, or other general-use receptacles, for example.

Figure 3:
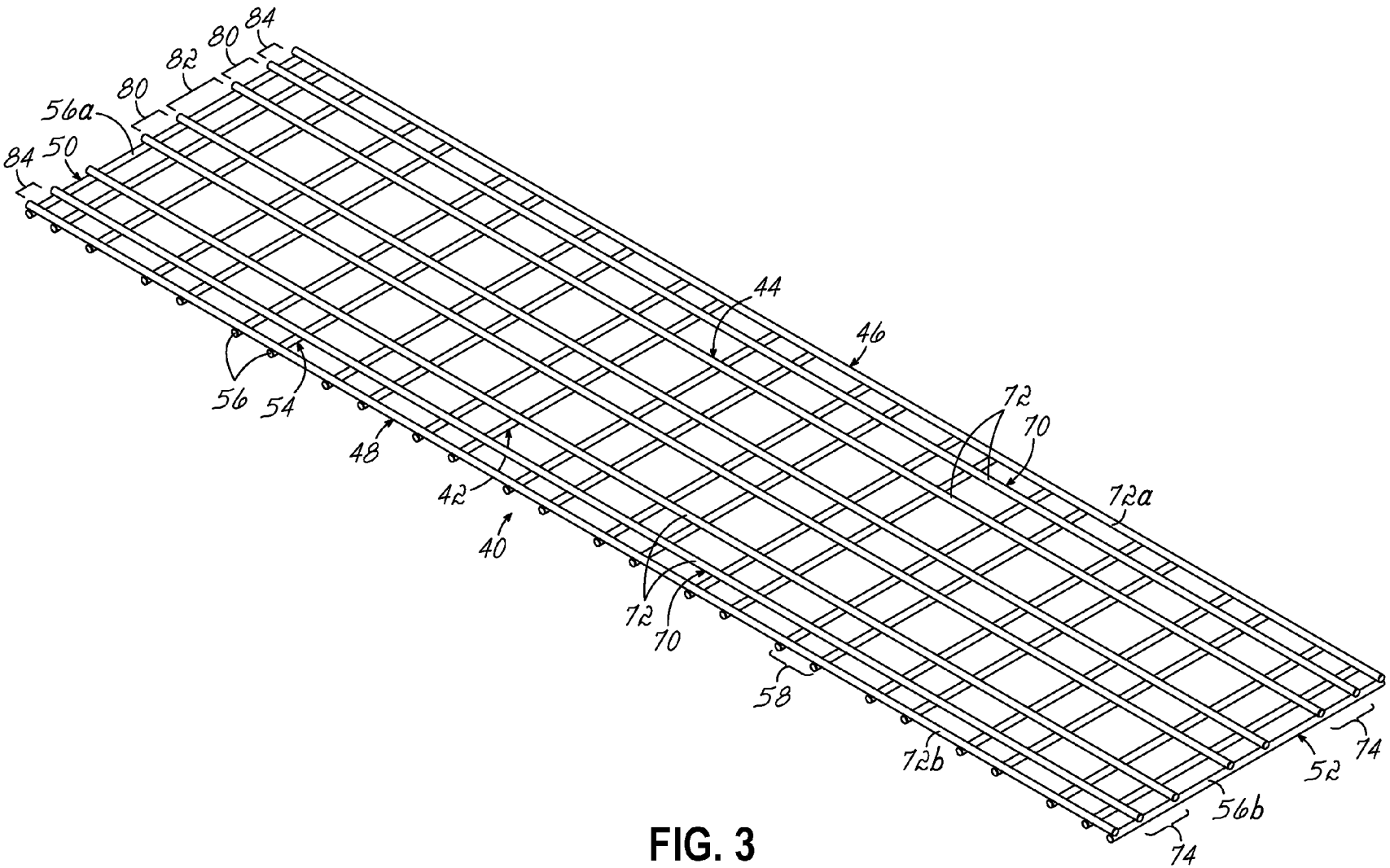
FIG. 3 is a perspective view similar to FIG. 2, showing the shelf in a second orientation.
Figure 4:
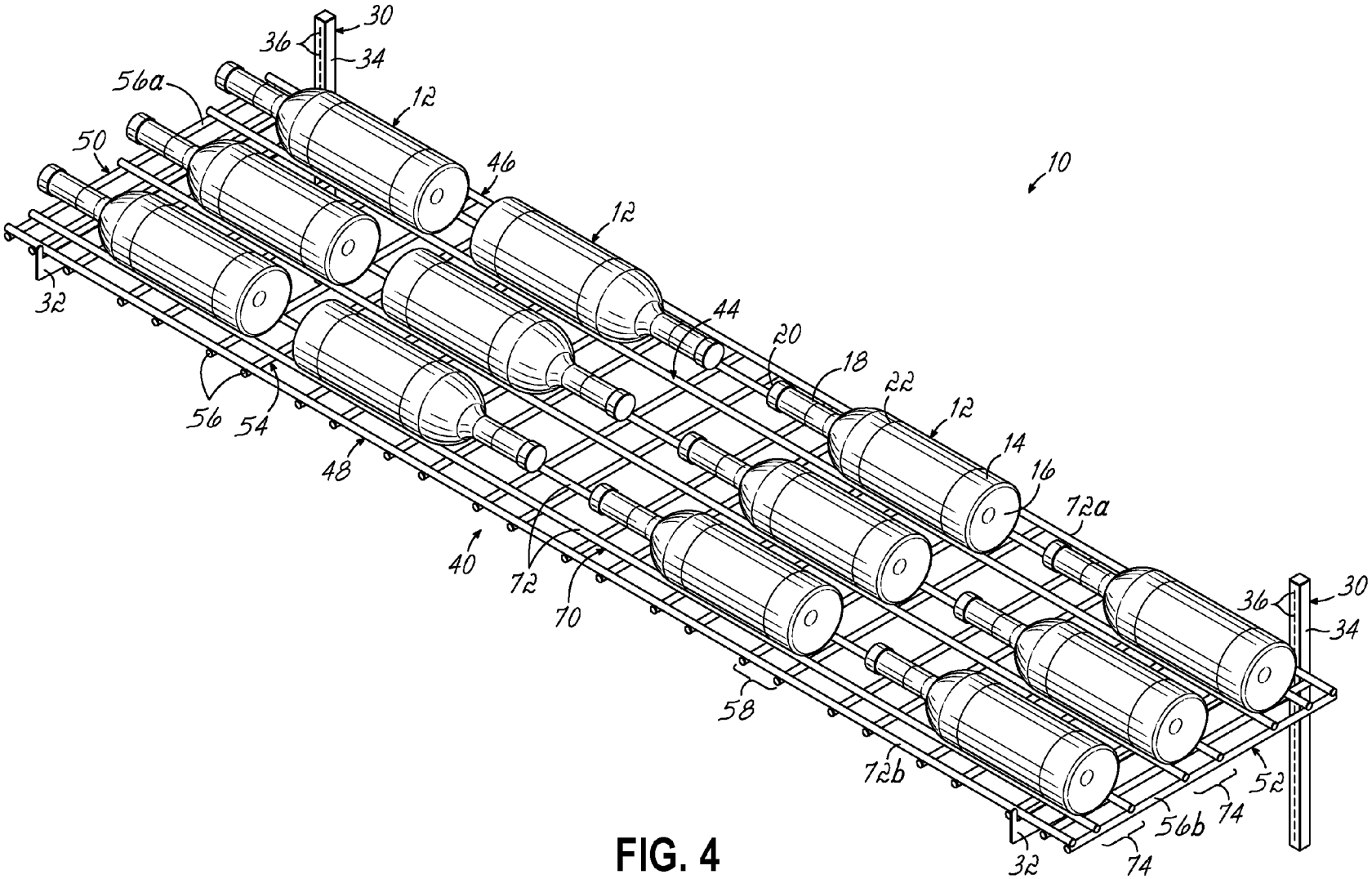
FIG. 4 is a perspective view similar to FIG. 3, showing the shelf in the second orientation and supporting a plurality of articles.

The support 10 includes a shelf 40 that is selectively adjustably couplable with a support frame 30 in at least a first orientation and a second orientation. The first orientation of the shelf 40 is shown in FIGS. 1, 2, 5, 7, and 8, and allows positioning of the bottles 12 such that their longitudinal axes are aligned in a first direction in which the closure-end 20 or the bottom-end 16 of each bottle 12 faces outwardly away from a back edge of the shelf 40 adjacent to the support frame 30, and toward an observer so the observer can readily view the labels 22. The second orientation of the shelf 40 is shown in FIGS. 3, 4, 6, and allows positioning of the bottles 12 such that their longitudinal axes are aligned in a second direction, perpendicular to the first direction, in which the body 14 of the bottle 12 faces outwardly away from a back edge of the shelf 40 adjacent to the support frame 30, and toward an observer so the observer can readily view the labels 22.

As shown, the support frame 30 may include one or more horizontally oriented support arms 32, each arm 32 engaging an underside of the shelf 40 for providing the shelf 40 with support in a vertical direction and securing the shelf 40 in a substantially horizontal position. In particular, the support arms 32 may be arranged to engage an underside of the shelf 40 near first and second lateral ends 50, 52 of the shelf 40. Additional support arms 32 may be employed as needed at various locations between the first and second lateral ends 50, 52 for providing the shelf 40 with an adequate degree of vertical support.

Each support arm 32 may be selectively adjustably coupled with a vertically oriented mount 34, shown in this embodiment in the form of an elongate rail, which may be anchored to a vertical surface such as a wall, for example. The mount 34 may include a plurality of slots 36 for adjusting a vertical position of the support arm 32, and thereby a vertical position of the shelf 40. Additionally, though not shown, each mount 34 may be sized to receive a plurality of support arms 32 for supporting a plurality of vertically spaced shelves 40. While the support frame 30 is shown and described herein as including one or more mounts 34 that may be anchored to a vertical surface, such as a wall, it will be appreciated that in alternative embodiments the shelf 40 may be supported by a free-standing frame or similar structure that is independent from walls or other similar surfaces.

Figure 2:
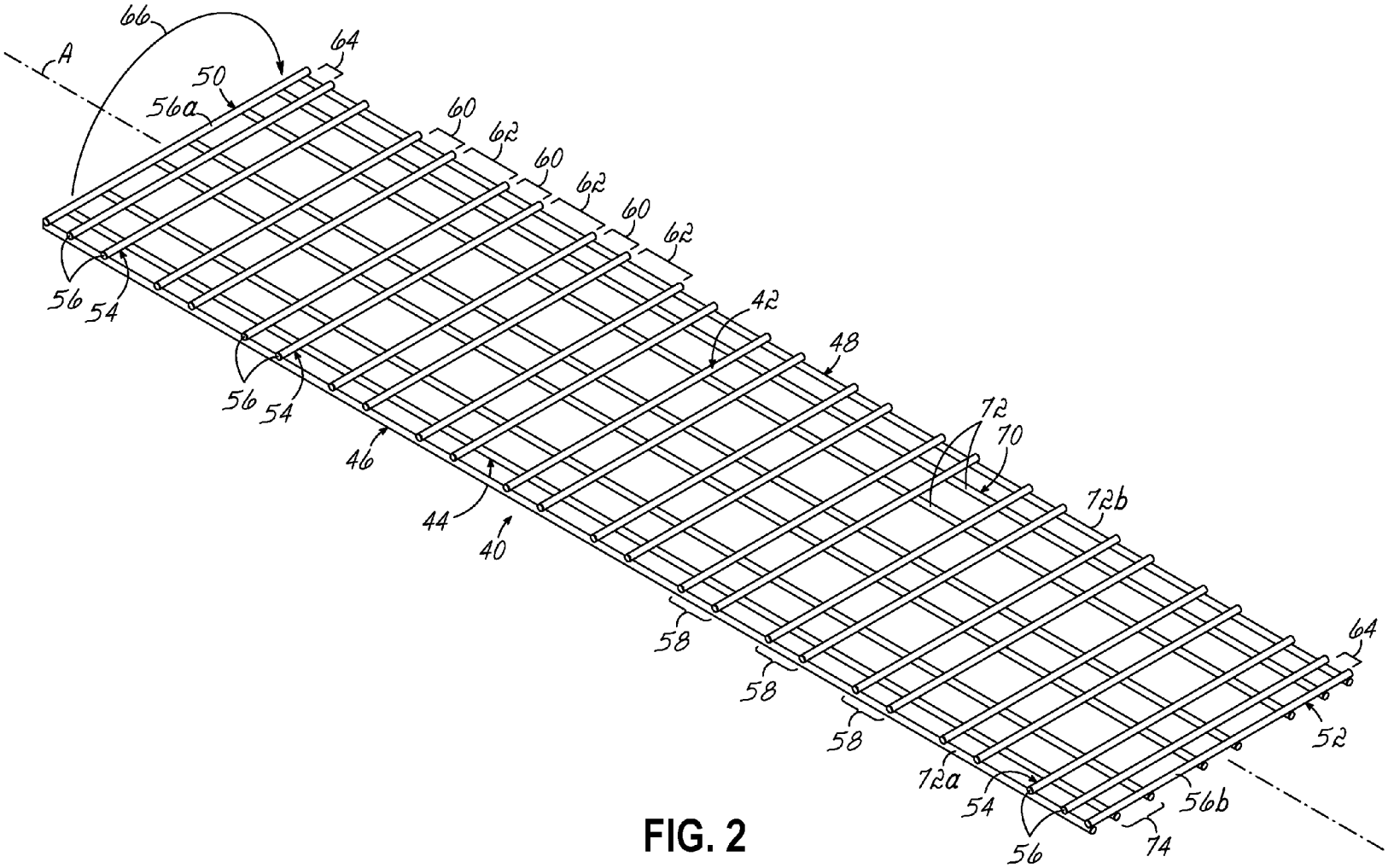
FIG. 2 is a perspective view similar to FIG. 1, showing a shelf of the support in a first orientation and indicating transitional movements toward a second orientation.

Referring to FIG. 2, additional structural features of the shelf 40 are shown. The shelf 40 includes a first side 42 and an oppositely disposed second side 44, described in greater detail below. The shelf 40 further includes oppositely disposed first and second longitudinal ends 46, 48 spanning a length of the shelf 40, and oppositely disposed first and second lateral ends 50, 52 spanning a width of the shelf 40. In the embodiment shown, the shelf 40 forms a substantially rectangular shape and defines a longitudinal axis A, with the longitudinal ends 46, 48 being formed substantially perpendicular to the lateral ends 50, 52. In alternative embodiments, the shelf 40 may be formed with any other suitable geometric shape having any suitable dimensions.

In the first orientation of the shelf 40, shown in FIG. 2, the first side 42 faces generally upward and the second side 44 faces generally downward. In this first orientation, the first longitudinal end 46 defines a front edge of the shelf 40, and the second longitudinal end 48 defines a back edge of the shelf 40. The back edge is positioned adjacent to the vertical support mounts 32, and the front edge extends outwardly from the back edge. As shown in FIG. 1, when in the first orientation, the shelf 40 is configured to support one or more bottles 12 thereon such that the closure-end 20 or the bottom-end 16 of each bottle 12 faces outwardly toward the front edge of the shelf 40. More specifically, the longitudinal axis of each bottle 12 is aligned transverse to the first and second longitudinal ends 46, 48 and transverse to the longitudinal axis A of the shelf 40.

The first side 42 of the shelf 40 includes first locating structure 54 for engaging and retaining one or more bottles 12 when the shelf 40 is in the first orientation. In the embodiment shown, the first locating structure 54 spans substantially the entire length of the shelf 40 such that one or more bottles 12 may be supported by the first locating structure 54 anywhere substantially along the entire length of the shelf 40. In this manner, substantially the entire length of the first side 42 of the shelf 40 may be employed for supporting one or more bottles 12, as described in greater detail below.

In the embodiment shown, the first locating structure 54 comprises a first set of elongate members 56. The elongate members 56 each define an axis and extend substantially transverse to the longitudinal axis A of the shelf 40 between the first longitudinal end 46 and the second longitudinal end 48. As shown, the elongate members 56 are arranged in a parallel, spaced apart configuration. A first terminal member **56*a* may define the first lateral end 50 of the shelf 40, and a second terminal member 56*b* may define the second lateral end 52**.

In the embodiment shown, the elongate members 56 are arranged in a series of spaced apart pairs 58. In particular, each pair 58 defines a primary space 60 therebetween that is sized to receive and retain a portion of the body 14 of a bottle 12 to thereby support the bottle 12 on the shelf 40 and to restrain movement of the bottle 12 in directions transverse to the longitudinal axis of the bottle 12. Additionally, each pair 58 of elongate members 56 is separated from an adjacent pair 58 by a secondary space 62, such that the elongate members 56 collectively define a series of alternating primary and secondary spaces 60, 62 along the length of the shelf 40. A tertiary space 64 may be formed between the first and second terminal members **56*a*, 56*b* and adjacent pairs 58 of elongate members 56. In use, one or more of the secondary spaces 62 could be used in a manner similar to the primary spaces 60 for receiving and retaining a portion of the body 14 of a bottle 12** as shown and described herein.

In the embodiment shown, the elongate members 56 are uniformly spaced such that the primary spaces 60 each define a common first width, the secondary spaces 62 each define a common second width, and the tertiary spaces 64 each define a common third width. The first width of the primary spaces 62 may be less than the second width of the secondary spaces 62, and the third width of the tertiary spaces 64 may be less than the first width of the primary spaces 60. In alternative embodiments, the elongate members 56 of first locating structure 54 may be non-uniformly spaced in various arrangements such that the primary, secondary, and/or tertiary spaces 60, 62, 64 do not define common first, second, and third widths, respectively. For example, one or more pairs 58 of the elongate members 56 could be arranged to define a primary space 60 having a width that is substantially larger than or smaller than widths of the remaining primary spaces 60. In this manner, the elongate members could receive a bottle 12 having a diameter that is substantially larger than or a substantially smaller than that of other bottles 12 to be supported by the elongate members 56.

Figure 7:
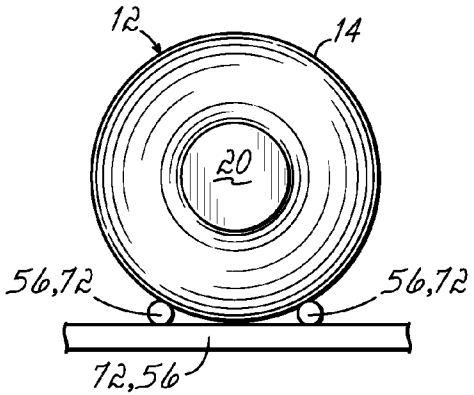
FIG. 7 is a partial front elevation view of the support in FIG. 1, showing an article being supported in a first direction by first locating structure.

In one embodiment, the primary space 60 defined by each pair 58 of elongate members 56 defines a first width that is less than a maximum outer width, such as an outer diameter, of the body 14 of a bottle 12 to be supported by the pair 58. In this manner, and as best shown in FIG. 7, the pair 58 of elongate members 56 tangentially contacts the body 14 of the bottle 12 on either side of the longitudinal axis of the bottle 12. Accordingly, movement of the bottle 12 in directions transverse to the longitudinal axis of the bottle 12, such as lateral rolling or sliding, may be restrained.

Referring now to FIGS. 3 and 4, the shelf 40 is shown in the second orientation in which the second side 44 faces generally upward and the first side 42 faces generally downward. In this second orientation, the first longitudinal end 46 defines a back edge of the shelf 40 adjacent to the support frame 30, and the second longitudinal end 48 defines a front edge of the shelf 40 extending outwardly from the back edge. As indicated by arrow 66 in FIG. 2, the shelf 40 may be transitioned between the first orientation and the second orientation by rotating the shelf 40 about its longitudinal axis A. As shown in FIG. 4, when in the second orientation, the shelf 40 is configured to support one or more bottles 12 thereon such that the body 14 of each bottle 12 faces outwardly toward the front edge of the shelf 40, and such that one of the closure-end 20 or the bottom-end 16 of each bottle 12 faces toward the first lateral end 50. More specifically, the longitudinal axis of each bottle 12 is aligned parallel with the first and second longitudinal ends 46, 48 and with the longitudinal axis A of the shelf 40.

The second side 44 of the shelf 40 includes second locating structure 70 for engaging and retaining one or more bottles 12 when the shelf 40 is in the second orientation. In the embodiment shown, the second locating structure 70 spans substantially the entire length of the shelf 40 such that one or more bottles 12 may be supported by the second locating structure 70 anywhere substantially along the entire length of the shelf 40. In this manner, substantially the entire length of the second side 44 of the shelf 40 may be employed for supporting one or more bottles 12, as described in greater detail below.

In the embodiment shown, the second locating structure 70 comprises a second set of elongate members 72. The elongate members 72 each define an axis and extend substantially parallel to the longitudinal axis A of the shelf 40 between the first lateral end 50 and the second lateral end 52. As shown, the elongate members 72 are arranged in a parallel, spaced apart configuration. A first terminal member 72*a* may define the first longitudinal end 46 of the shelf 40, and a second terminal member 72*b* may define the second longitudinal end 48.

Similar to the elongate members 56 of first locating structure 54, the elongate members 72 of second locating structure 70 may be arranged in a series of spaced apart pairs 74. In particular, each pair 74 may define a primary space 80 therebetween that is sized to receive and retain a portion of the body 14 of a bottle 12 to thereby support the bottle 12 on the shelf 40, and to restrain movement of the bottle 12 in directions transverse to the longitudinal axis of the bottle 12. Additionally, each pair 74 of elongate members 72 is separated from an adjacent pair 74 by a secondary space 82, such that the elongate members 72 collectively define a series of alternating primary and secondary spaces 80, 82 along the width of the shelf 40. A tertiary space 84 may be formed between the first and second terminal members 72*a*, 72*b* and adjacent pairs 74 of elongate members 72. In use, one or more of the secondary spaces 82 could be used in a manner similar to the primary spaces 80 for receiving and retaining a portion of the body 14 of a bottle 12 as shown and described herein.

In the embodiment shown, the elongate members 72 are uniformly spaced such that the primary spaces 80 each define a common first width, the secondary spaces 82 each define a common second width, and the tertiary spaces 84 each define a common third width. The first width of the primary spaces 80 may be less than the second width of the secondary spaces 82, and the third width of the tertiary spaces 84 may be less than the first width of the primary spaces 80. In alternative embodiments, as described above in connection with first locating structure 54, the elongate members 72 of second locating structure 70 may be non-uniformly spaced in various arrangements such that the primary, secondary, and/or tertiary spaces 80, 82, 84 do not define common first, second, and third widths, respectively.

In one embodiment, and similar to first locating structure 54 described above, the primary space 80 defined by each pair 74 of elongate members 72 of second locating structure 70 defines a first width that is less than a maximum outer width, such as an outer diameter, of the body 14 of a bottle 12 to be supported by the pair 74. In this manner, the pair 74 of elongate members 72 tangentially contacts the body 14 of the bottle 12 on either side of the longitudinal axis of the bottle 12, as shown in FIG. 7. Accordingly, movement of the bottle 12 in directions transverse to the longitudinal axis of the bottle 12, such as lateral rolling or sliding, may be restrained.

Figure 5:
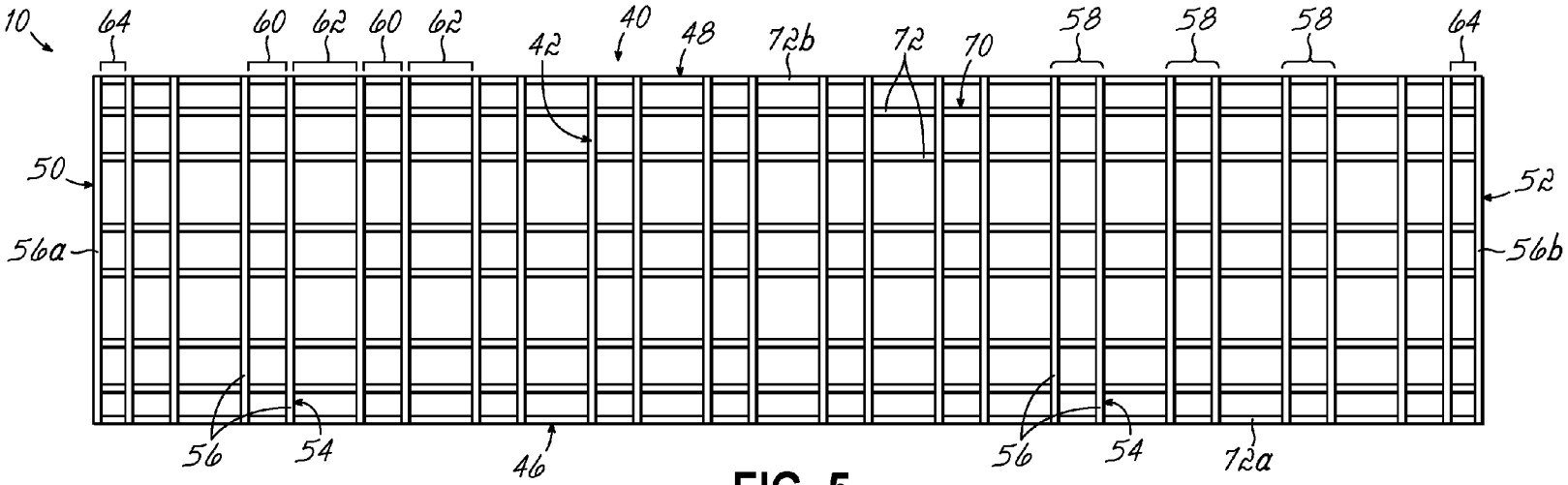
FIG. 5 is a plan view, showing the support of FIG. 1 in the first orientation.
Figure 6:
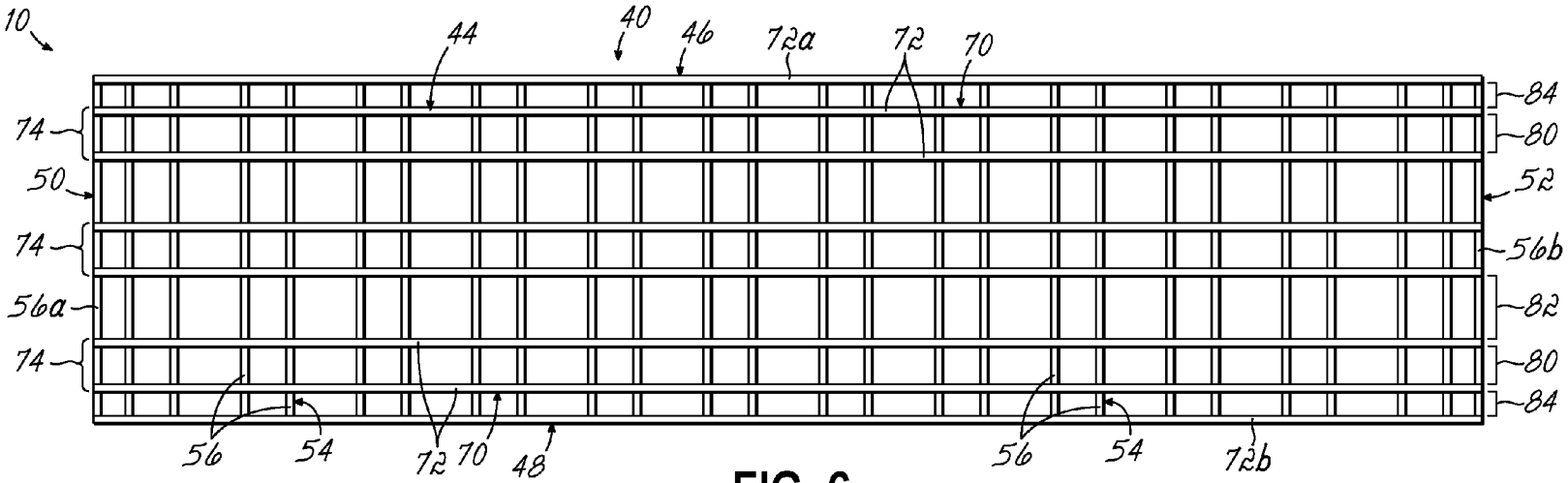
FIG. 6 is a plan view similar to FIG. 5, showing the support in the second orientation.

FIGS. 5 and 6 show top views of the shelf 40 provided in the first orientation and the second orientation, respectively. As shown, the elongate members 56, 72 of first and second locating structures 54, 70 are arranged perpendicular to and overlie each other, thereby forming a grid-like pattern having first and second stacked layers. In this manner, each of the primary, second, and tertiary spaces 60, 62, 64 defined by the first elongate members 56 is positioned directly vertically above each of the primary, second, and tertiary spaces 80, 82, 84 defined by the second elongate members 72 when the shelf 40 is in the first orientation. Similarly, each of the spaces 80, 82, 84 is positioned directly vertically above each of the spaces 60, 62, 64 when the shelf 40 is in the second orientation. Additionally, as shown in FIG. 1, first locating structure 54 of the first side 42 of the shelf 40 may support a plurality of bottles 12 arranged in a formation having a single row. As shown in FIG. 4, second locating structure 70 of the second side 44 may support the same number of bottles 12 arranged in a formation having multiple rows and multiple columns.

Persons skilled in the art will appreciate that the shelf 40, including the elongate members 56, 72, may be formed of any suitable material or materials, and through any suitable manufacturing method. Additionally, the elongate members 56, 72 may be formed with any suitable cross-sectional shape. For example, in one embodiment, each elongate member 56, 72 may be an independent rod-like structure formed of a metal and having a circular cross-sectional shape. The individual elongate members 56, 72 may be permanently affixed to one another at various points of contact, for example through welding, thereby forming the shelf 40. In other embodiments, the elongate members 56, 72 may be independent rod-like members formed of plastic, wood, and/or various composite materials, for example, and may be joined together using any suitable joining method. In other embodiments, the shelf 40 may be formed as a single monolithic structure, for example through injection molding or various machining operations.

Referring to FIG. 7, a partial front elevation view of a portion of the shelf 40 in the first orientation is shown, where a bottle 12 is being supported by a pair 58 of elongate members 56 of first locating structure 54 of the first side 42 of the shelf 40. FIG. 7 also serves as a partial side elevation view of a portion of the shelf 40 in the second orientation, showing the bottle 12 being supported by a pair 74 of elongate members 72 of second locating structure 70 of the second side 44. As shown, and as described above, the pair 58, 74 of elongate members 56, 72 contacts the bottle 12 tangentially such that a portion of the body 14 of the bottle 12 is received within a primary space 60, 80 defined by the pair 58, 74 of elongate members 56, 72.

Figure 8:
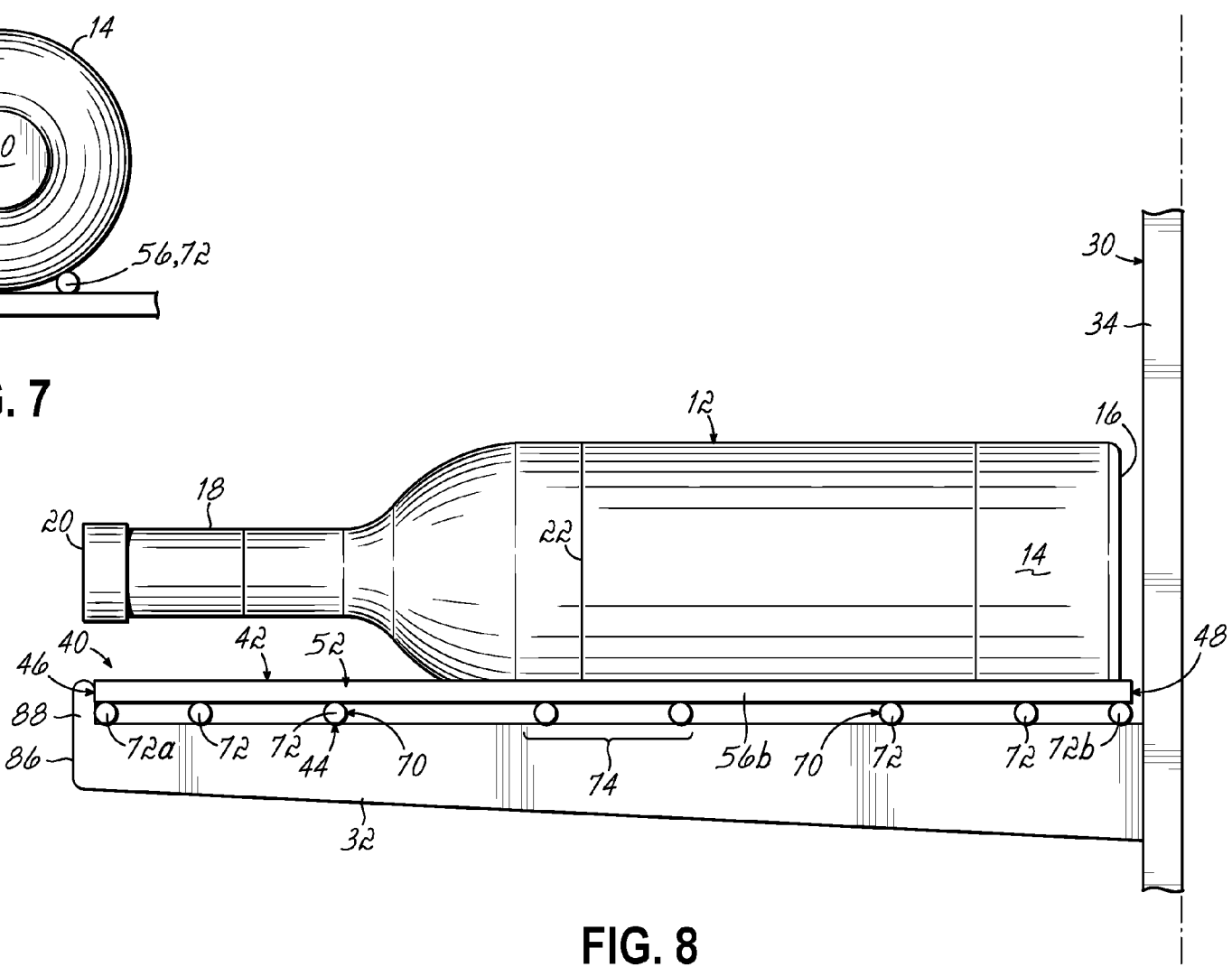
FIG. 8 is side elevation view of the support of FIG. 1, showing details of a support frame.

Referring to FIG. 8, a side elevation view of the shelf 40 in the first orientation is shown. As described above, each support arm 32 of the support frame 30 may extend along an underside of the shelf 40 for the full width of the shelf 40, thereby supporting the shelf 40 in a vertical direction. In particular, when the shelf 40 is in the first orientation, the arm 32 extends along the second side 44 of the shelf 40, as shown. When the shelf 40 is in the second orientation, the arm 32 extends along the first side 42 of the shelf 40. In alternative embodiments, one of more of the arms 32 may extend less than a full width of the shelf 40. Additionally, a distal end 86 of each arm 32 may include a lip 88 for securing the shelf 40 on the arm 32 and preventing the shelf 40 from sliding outwardly away from the mount 34.

While the support 10 is shown and described herein for supporting articles in the form of individual bottles 12, it will be appreciated that the support 10 may be employed for bulk storage as well. For example, the shelf 40 may support cases of articles, such as bottles, in place of or in combination with individual articles.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of the general inventive concept.

What is claimed is:

1. A support for storing and displaying elongate articles, the support comprising:

at least one shelf having first and second sides and being selectively adjustably couplable with a support frame in at least a first orientation in which the first side faces in a generally upward direction and a second orientation in which the second side faces in a generally upward direction;

first locating structure on the first side of the at least one shelf and associated with the first orientation, the first locating structure engagable with at least one elongate article placed in contact with the first locating structure to locate the at least one elongate article on the at least one shelf so that a longitudinal axis of the at least one elongate article is aligned generally horizontally in a first direction;

second locating structure on the second side of the at least one shelf and associated with the second orientation, the second locating structure engagable with an elongate article when the elongate article is placed in contact with the second locating structure to locate the elongate article on the at least one shelf so that the longitudinal axis of the elongate article is aligned generally horizontally in a second direction, wherein a longitudinal axis of the first locating structure extends in a different direction than a longitudinal axis of the second locating structure.

2. The support of claim 1, wherein the first and second sides are oppositely disposed.

3. The support of claim 1, wherein:

the first locating structure is engagable with the at least one elongate article so that the longitudinal axis of the at least one elongate article is aligned generally parallel with the longitudinal axis defined by the first locating structure, and the second locating structure is engagable with the elongate article when the elongate article is placed in contact with the second locating structure so that the longitudinal axis of the elongate article is aligned generally parallel with the longitudinal axis defined by the second locating structure.

4. The support of claim 1, wherein the longitudinal axis defined by the first locating structure is generally perpendicular to the longitudinal axis defined by the second locating structure such that the second direction of the elongate article is generally perpendicular to the first direction of the at least one elongate article.

5. The support of claim 1, wherein the first locating structure comprises a plurality of first elongate members, the first elongate members being arranged in a parallel spaced apart configuration in which longitudinal axes of the first elongate members are oriented in the first direction, the first elongate members defining at least one first space therebetween for receiving and retaining the at least one elongate article placed in contact with the first elongate members.

6. The support of claim 5, wherein the second locating structure comprises a plurality of second elongate members, the second elongate members being arranged in a parallel spaced apart configuration in which longitudinal axes of the second elongate members are oriented in the second direction, the second elongate members defining at least one second space therebetween for receiving and retaining the elongate article placed in contact with the second elongate members.

7. The support of claim 6, wherein the first elongate members and the second elongate members collectively define a grid structure.

8. The support of claim 6, wherein the at least one first space defines a first width, the at least one second space defines a second width, and the at least one elongate article and the elongate article each defines an article width transverse to the longitudinal axis thereof, each of the first width and the second width being less than the article widths.

9. The support of claim 1, wherein the support is configured to store and display a plurality of elongate articles, and wherein at least one of the first locating structure or the second locating structure is adapted to support the plurality of elongate articles anywhere substantially along the entire length of the at least one shelf.

10. The support of claim 9, wherein the at least one of the first locating structure or the second locating structure is engagable with the plurality of elongate articles to locate the plurality of elongate articles on the at least one shelf so that the longitudinal axes of the plurality of elongate articles are collectively aligned in one of the first direction or the second direction.

11. The support of claim 1, wherein the support is configured to store and display a plurality of elongate articles, and wherein at least one of the first locating structure or the second locating structure is adapted to support the plurality of elongate articles arranged in a plurality of rows and a plurality of columns.

12. The support of claim 1, wherein the at least one shelf includes a first shelf and a second shelf, the first shelf coupled with the support frame in the first orientation and the second shelf coupled with the support frame in the second orientation.

13. A method of storing and displaying elongate articles, the method comprising:

obtaining a support including at least one shelf having a first side with first locating structure and a second side with second locating structure, the first and second locating structures each configured to locate at least one of the elongate articles generally horizontally, the at least one shelf positionable in a first orientation wherein the first side faces in a generally upward direction, and a second orientation wherein the second side faces in a generally upward direction;

selectively providing a first shelf of the at least one shelf in the first orientation; and supporting the at least one elongate article on the first shelf anywhere substantially along the entire length of the first shelf such that the first locating structure engages the at least one elongate article and aligns a longitudinal axis of the at least one elongate article parallel with a first direction defined by a longitudinal axis of the first locating structure, wherein the longitudinal axis of the first locating structure extends in a different direction than a longitudinal axis of the second locating structure.

14. The method of claim 13, wherein the support includes a second shelf, the method further comprising:

selectively providing the second shelf in the second orientation; and supporting at least one of the elongate articles on the second shelf anywhere substantially along the entire length of the second shelf such that the second locating structure engages the at least one elongate article and aligns a longitudinal axis of the at least one elongate article parallel with a second direction defined by the longitudinal axis of the second locating structure.

15. The method of claim 14, wherein the longitudinal axis of the first locating structure is generally perpendicular to the longitudinal axis of the second locating structure such that the first direction is generally perpendicular to the second direction.

16. The method of claim 13, wherein supporting the at least one elongate article includes supporting a plurality of elongate articles arranged in a plurality of rows and a plurality of columns.

17. The method of claim 13, further comprising:

selectively transitioning the first shelf from the first orientation to the second orientation; and supporting at least one of the elongate articles on the first shelf anywhere substantially along the entire length of the first shelf such that the second locating structure engages the at least one elongate article and aligns a longitudinal axis of the at least one elongate article parallel with a second direction defined by the longitudinal axis of the second locating structure.

18. The method of claim 17, wherein selectively transitioning the first shelf from the first orientation to the second orientation includes rotating the first shelf about a longitudinal axis defined by the first shelf.

19. The method of claim 17, wherein the longitudinal axis of the first locating structure is generally perpendicular to the longitudinal axis of the second locating structure such that the first direction is generally perpendicular to the second direction.

* * * * *